US007797865B2

(12) United States Patent
Patel et al.

(10) Patent No.: US 7,797,865 B2
(45) Date of Patent: Sep. 21, 2010

(54) CHANGEABLE MESSAGE SIGN STRUCTURE

(75) Inventors: Milan Patel, Concord (CA); Mark Grzesik, Mississauga (CA)

(73) Assignee: Ledstar Inc., Woodbridge, ON (CA)

( * ) Notice: Subject to any disclaimer, the term of this patent is extended or adjusted under 35 U.S.C. 154(b) by 0 days.

(21) Appl. No.: 11/730,757

(22) Filed: Apr. 4, 2007

(65) Prior Publication Data

US 2008/0244942 A1 Oct. 9, 2008

(51) Int. Cl.
*G09F 3/04* (2006.01)

(52) U.S. Cl. ..... 40/451; 52/222; 40/564

(58) Field of Classification Search ..... 40/446, 40/451, 452, 461, 463, 489, 612, 536, 537, 40/605, 573, 575, 729, 735, 611.01, 611.06–611.08, 40/618.01; 52/762, 764, 780, 781, 779, 777, 52/506.06, 506.07, 235
See application file for complete search history.

(56) References Cited

U.S. PATENT DOCUMENTS

| | | | | | |
|---|---|---|---|---|---|
| 2,976,966 | A * | 3/1961 | Latzko | ..... | 52/234 |
| 3,336,705 | A * | 8/1967 | Buck et al. | ..... | 52/222 |
| 3,550,298 | A * | 12/1970 | O'Neill | ..... | 40/545 |
| 4,679,375 | A * | 7/1987 | Shirey | ..... | 52/777 |
| 4,998,365 | A * | 3/1991 | Bezek | ..... | 40/545 |
| 5,396,724 | A * | 3/1995 | Dinsmore | ..... | 40/612 |
| 5,435,087 | A * | 7/1995 | Karkar et al. | ..... | 40/575 |
| 5,497,573 | A * | 3/1996 | Stadjuhar et al. | ..... | 40/564 |
| 5,579,624 | A * | 12/1996 | Aeberhard | ..... | 52/586.2 |
| 6,282,824 | B1 * | 9/2001 | Noll et al. | ..... | 40/594 |
| 6,314,669 | B1 | 11/2001 | Tucker | | |
| 6,526,716 | B2 * | 3/2003 | Paul | ..... | 52/506.06 |
| 6,741,222 | B1 * | 5/2004 | Tucker | ..... | 345/1.1 |
| 2004/0123501 | A1 * | 7/2004 | Safavi et al. | ..... | 40/452 |
| 2006/0279493 | A1 * | 12/2006 | Syrstad | ..... | 345/82 |

* cited by examiner

*Primary Examiner*—Joanne Silbermann
*Assistant Examiner*—Shin Kim

(57) ABSTRACT

A changeable message sign structure has a front panel assembly and rear, top, bottom and left and right end panels which define a hollow sign interior. The front panel assembly has a frame with upper, lower and left and right side frame members. At least two vertical support members are attached to the upper and lower frame members. The vertical support members each have a generally T-shaped cross-section with a rearwardly extending stem and left and right arms, each with arm flanges extending rearwardly to define securement slots between the arm flanges and the stem. At least one panel web assembly has frontwardly extending side flanges engaged within a securement slot of each of two neighbouring vertical support members. A web assembly support structure is pressed against the at least one panel web assembly and removably attached to the rearwardly extending stems of two neighbouring vertical support members. At least one changeable message electronic sign module is attached to the web assembly support structure. In another aspect, the invention relates to a method of changing a panel web assembly in the sign structure. The method has the steps of, from the interior of the sign structure, detaching the removably attached web assembly support structure from the rearwardly extending stems of two neighbouring vertical support members, removing an exposed panel web assembly from its position against the arms, positioning a panel web assembly against the arms, pressing the web assembly support structure against the positioned panel web assembly and removably attaching same to the rearwardly extending stems.

9 Claims, 12 Drawing Sheets

68
66b
64b
64
66
74
62
80
72
84
86
82
104
120
114
124
116
126
128
118
94
92
90
88
70
70a
76
64a
66a

CHANGEABLE MESSAGE SIGN STRUCTURE

FIELD OF THE INVENTION

The invention relates to the structure of large-scale changeable message signs, such as would be used over or adjacent roads or highways to provide information to passing motorists.

BACKGROUND OF THE INVENTION

Large-scale changeable message sign structures are known in the art. Typically, such sign structures present a front face assembly the outer layer of which is an opaque panel with an array of regularly spaced openings therein. This layer, known as an aperture mask, has aligned behind it an array of electronically controlled sign pixel elements, visible through the aperture mask openings. In current practice, the pixel elements are often clusters of light-emitting diodes (LEDs). The operation of the pixel elements is electronically controlled by a controller and appropriate circuitry to present a desired message to viewers, such as passing motorists. Typically, interposed between the aperture mask and the sign pixel elements is a window panel, the purpose of which is to prevent the ingress through the mask openings of potentially damaging environmental agents, such as water, dust, salt spray, insects and the like, into the sign interior.

From time to time, it may be necessary to service or replace the aperture mask panel and/or window panel, as they can deteriorate with age (for example, ultraviolet exposure may damage a window panel) or be damaged by various occurrences, such as accidents, severe weather conditions or even acts of vandalism. It is thus desirable to be able to have access to these panels for the purpose of inspection, servicing or replacement.

In some prior art structures, the aperture mask and/or window panel are attached to the sign structure from the exterior and thus can only be accessed from the sign exterior. In other prior art structures, although it may be theoretically possible to access the aperture mask and/or window panel from the interior, it may be difficult or impractical, particularly if a significant amount of internal sign structure must first be removed. For example, as shown in FIG. 12 of U.S. Pat. No. 5,497,573, some prior art aperture mask panels can be relatively large. This fact suggests that significant internal sign structure must be removed to access the panels. Moreover, their sheer size may make it preferable, for practicality or safety reasons, to handle them from the exterior. In addition, seams between panels are required to be caulked or sealed, a step which may be better accomplished from the exterior. For any such structures, to access the sign exterior, it may be necessary to close the highway, either partially or completely, thus interfering with traffic flow and potentially increasing risk for motorists and at least causing inconvenience.

In other prior art structures, such as shown in U.S. patent publication no. U.S. 2004/0123501 and U.S. Pat. No. 6,741,222, aperture mask modules or related components are bolted together in a manner that makes it impossible or at least impractical to remove and replace individual aperture mask modules and window panels. For example, in the structure of U.S. Pat. No. 6,741,222, to remove a particular mask panel, many, if not all, of the components shown in FIGS. 4 and 5 would have to be removed not only from that panel but also from the neighboring panels on each side, so as to access the bolts (shown in FIG. 10 thereof) holding such panels together. In addition to the time and effort needed to disassemble and then later re-assemble such a structure, there is increased risk of damage to components or error in re-assembly. In some versions of these structures, a vertical support bar and/or sealant material is provided between adjacent channel-shaped aperture mask modules, such that, even if it were possible to remove a single mask module from the interior of the sign, there would be a danger that in the removal process the vertical bar and/or gasket material might fall to the road surface below, thus posing a hazard; moreover, in replacing such a removed module, it would be extremely difficult or impossible to replace the vertical bar and gasket material. The silicone sealant material specified in U.S. Pat. No. 6,741,222 can only be applied from the sign exterior, a fact which essentially eliminates any advantage in attempting to remove and replace a mask module from the sign interior.

As noted above, some prior art structures require the use of sealant materials, such as silicone, between aperture mask panels or modules. Some common sealant materials, particularly silicone, are known to degrade with time, especially when exposed to sunlight. Such signs thus suffer from the additional disadvantage that they will require additional maintenance (likely from the sign's exterior) from time to time to replace or repair such sealant material.

Moreover, some prior art structures suggest that the same sealant material may be used with other components of the structure, for example to seal an aperture mask panel to a window panel. The problem in doing so is that the sealant, again particularly silicone sealant, can be difficult to remove, thus making it more difficult to effectively service a damaged panel structure.

There thus remains a need for a sign structure which allows convenient access from a sign's interior to the aperture mask and window panels so as to allow the servicing thereof.

SUMMARY OF THE INVENTION

The present invention is directed to a changeable message sign structure having a front panel assembly and rear, top, bottom and left and right end panels which define a hollow sign interior. The front panel assembly comprises a frame having upper, lower and left and right side frame members. At least two vertical support members are attached to the upper and lower frame members. The vertical support members each define a generally T-shaped cross-section with a rearwardly extending stem and left and right arms, each with arm flanges extending rearwardly to define securement slots between the arm flanges and the stem. At least one panel web assembly has frontwardly extending side flanges engaged within a securement slot of each of two neighboring vertical support members. A web assembly support structure is pressed against the at least one panel web assembly and removably attached to the rearwardly extending stems of said two neighboring vertical support members. At least one changeable message electronic sign module is attached to the web assembly support structure.

In another embodiment, the invention is directed to a method of changing a panel web assembly in a changeable message sign structure of the type described above. The method comprises the steps of, from the interior of the sign structure, detaching the removably attached web assembly support structure from the rearwardly extending stems of two neighboring vertical support members, removing an exposed panel web assembly from its position against said arms, positioning a panel web assembly against said arms, pressing the web assembly support structure against the positioned panel web assembly and removably attaching same to the rearwardly extending stems.

IN THE DRAWINGS

Preferred embodiments of the present invention are illustrated in the attached drawings in which.

DETAILED DISCLOSURE

A preferred embodiment of a sign structure of the present invention is illustrated in the attached figures.

Figure 1:
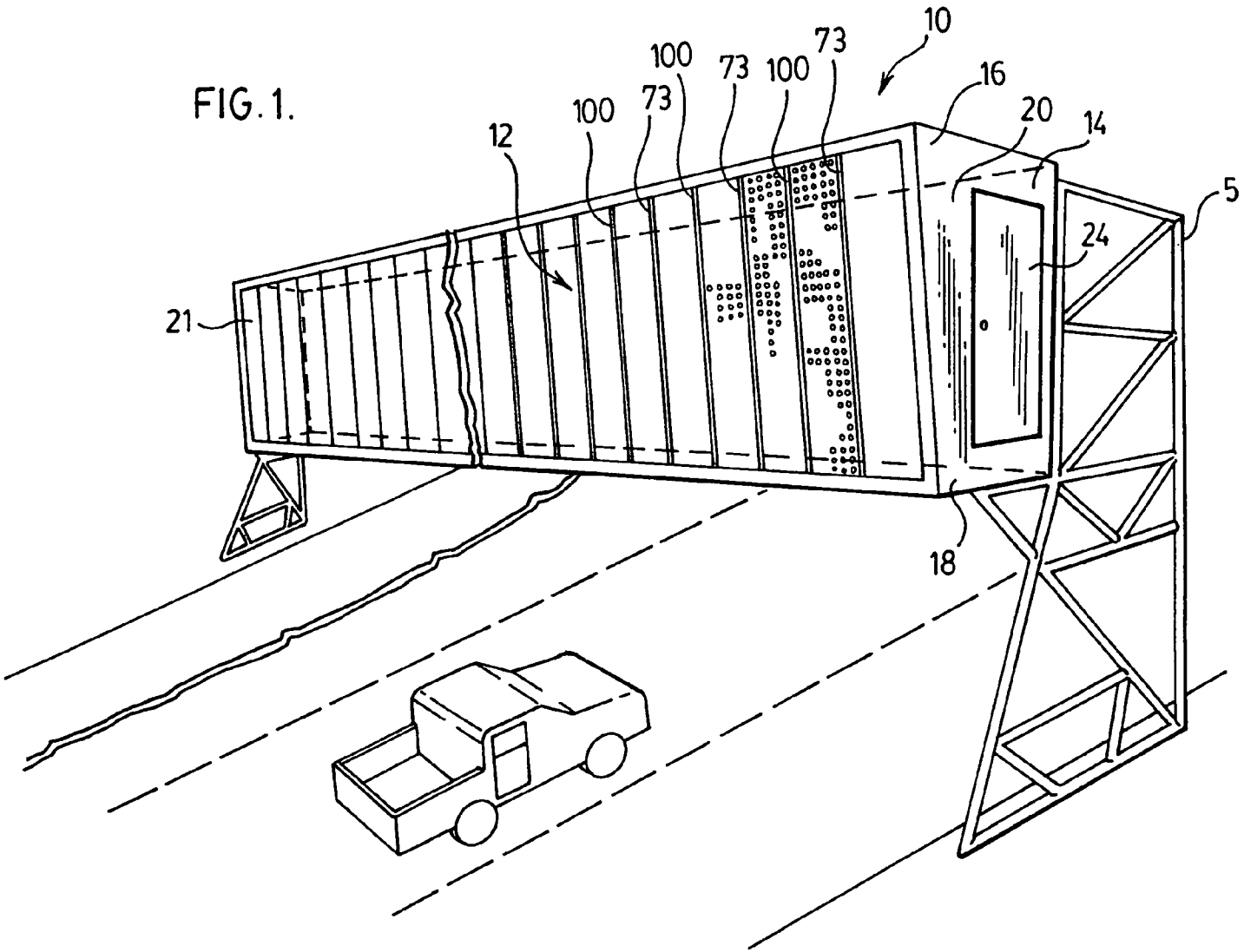
FIG. 1 is a perspective view of a preferred embodiment of the present invention.

Referring now to FIG. 1, there is shown a changeable message sign structure 10 according to the invention.

As shown in FIG. 1, sign structure 10 may be mounted on a support structure S which spans a road or highway, or portion thereof, so that sign structure 10 is visible to passing motorists. Alternatively, sign structure 10 may be mounted adjacent to a road or highway on different mounting structure (not shown), where it may also be visible to passing motorists.

Typical dimensions for a sign structure 10 may be about 25 ft long by 7 ft high by 3.5 ft wide but could range from about 10 ft long by 6 ft high by 1 ft wide to about 30 ft long by 8 ft high by 4 ft wide.

Figure 2:
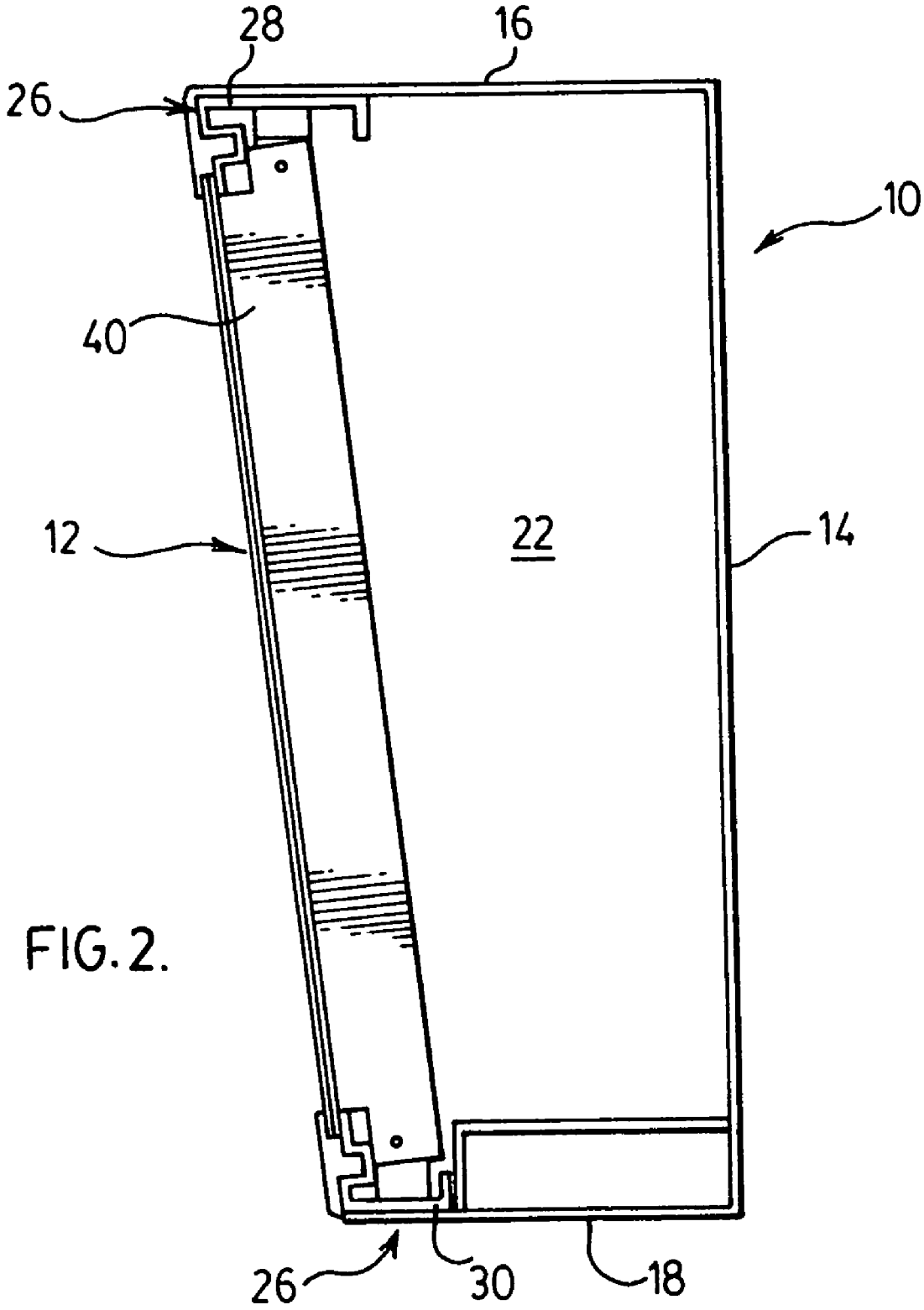
FIG. 2 is a vertical cross-section of a sign according to the present invention at an early stage of its construction.
Figure 3:
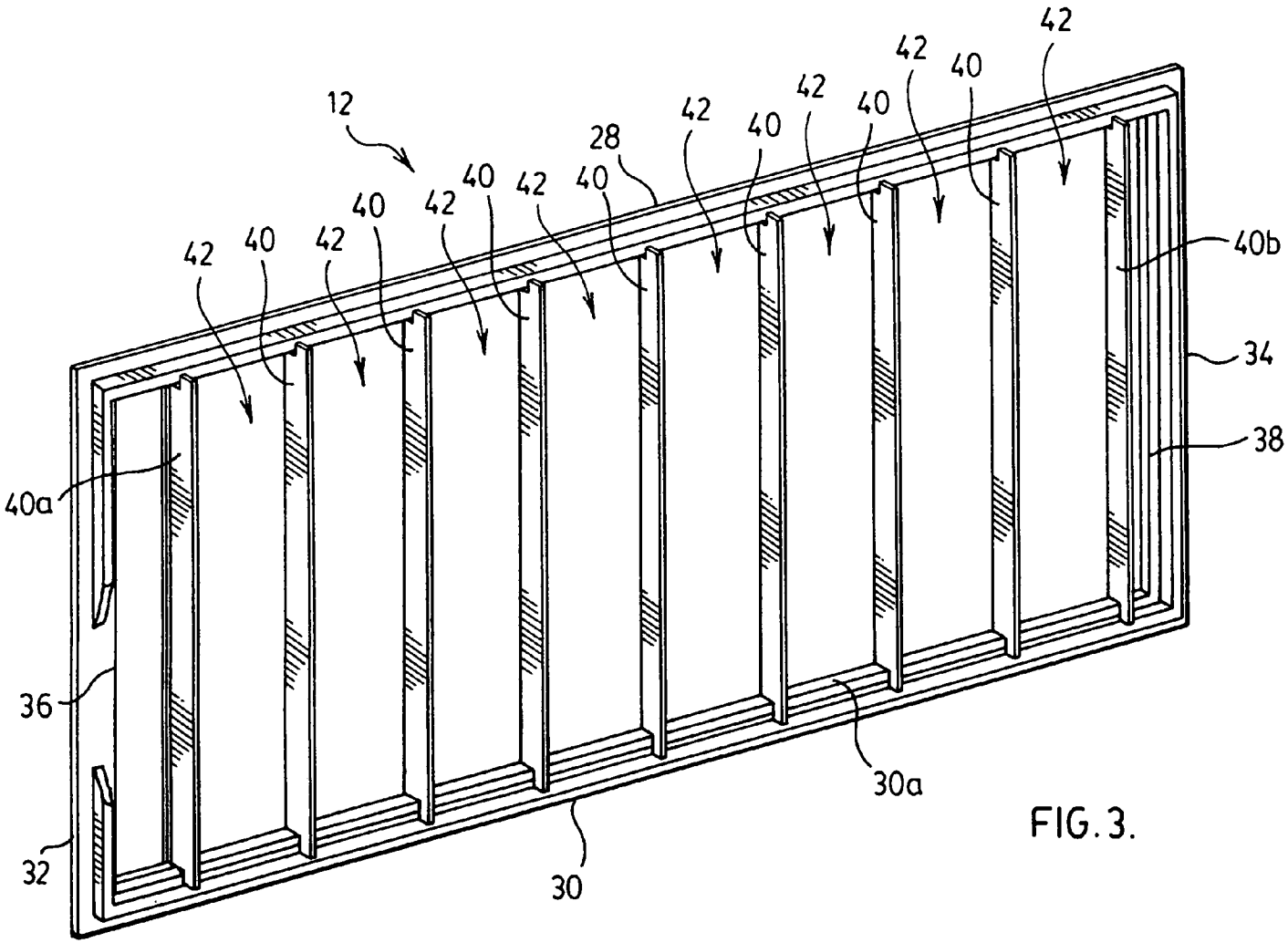
FIG. 3 is a perspective view of the front panel assembly of a sign according to the present invention at an early stage of its construction.

As shown in FIGS. 1 and 2, sign structure 10 comprises a front panel assembly 12, a rear panel 14, a top panel 16, a bottom panel 18, a left end panel 20 and a right end panel 21 (shown in hidden lines in FIG. 1). Front panel assembly 12 and panels 14, 16, 18, 20 and 21 define an enclosure with a hollow sign interior 22.

One of said panels 14, 16, 18, 20 and 21 has an access door 24. If sign structure 10 is to be mounted over a road or highway, such as is shown in FIG. 1, preferably access door 24 is located on an end panel, such as left end panel 20, where sign interior 22 may be accessed from the side of the highway with the possibility of being able to access the sign interior for service requirements without having to block all of part of the highway. It will be appreciated that blocking the highway, either completely or even partially, can greatly interfere with traffic flow.

Referring to FIGS. 2 to 5, front panel assembly 12 comprises a frame structure 26 having upper and lower frame members 28 and 30 as well as left and right side frame members 32 and 34. The side frame members define panel support surfaces 36 and 38.

At least two vertical support members 40 are attached to the upper and lower frame members 28 and 30. However, in most cases, multiple, regularly spaced vertical support members 40 are attached to upper and lower frame members 28 and 30. Upper and lower frame members 28 and 30 and neighboring vertical support members 40 define generally rectangular openings 42 therebetween.

Typically, the regular spacing between vertical support members is preferably about 20 to 30 inches, and even more preferably about 26 inches apart. Closer spacings are possible but may result in a higher cost for sign structure 10; wider spacings are also possible but may result in a weaker sign structure. Thus, in a typical highway sign about 25 feet long by 7 feet high, with a spacing of about 26 inches, there may be about 11 vertical support members 40 and the size of each rectangular opening 42 is about 15.2 square feet. Because rectangular openings 42 are filled by manually removable panel assemblies (as described below), dimensions of about such magnitudes are reasonably convenient to work with manually.

It will be noted that, at either or both sides of front panel assembly 12, the spacing between a left-most or a right-most vertical support member 40*a* or 40*b* and its neighboring left-side frame member 32 or right-side frame member 34, as the case may be, may be different from the regular spacing between neighboring vertical support members. For this and other reasons, a somewhat different arrangement (to be described below) is used to complete the sign structure at the left and right hand sides of front panel assembly 12.

Figure 4:
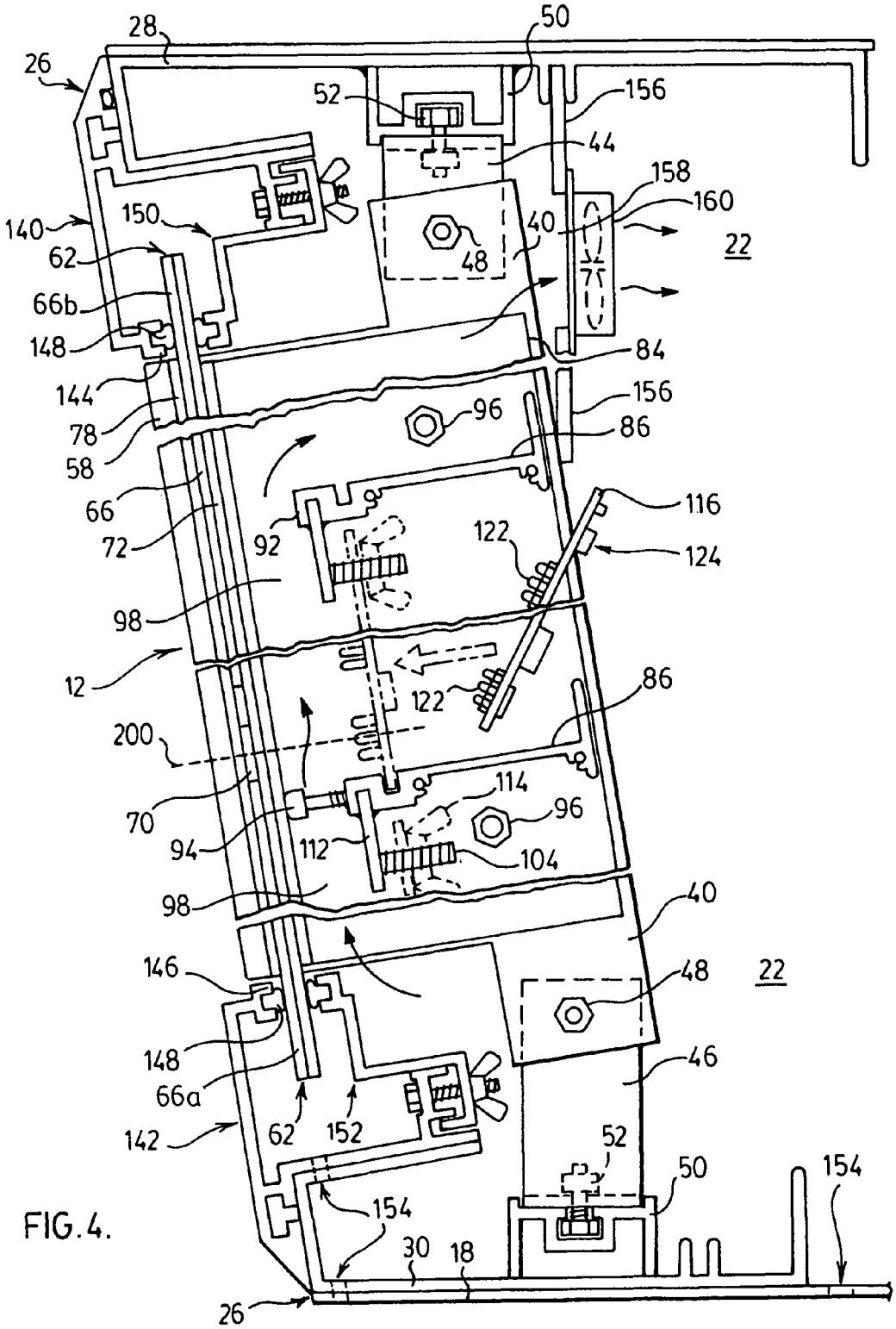
FIG. 4 is a vertical cross-section of the front panel assembly of a sign according to the present invention.
Figure 8:
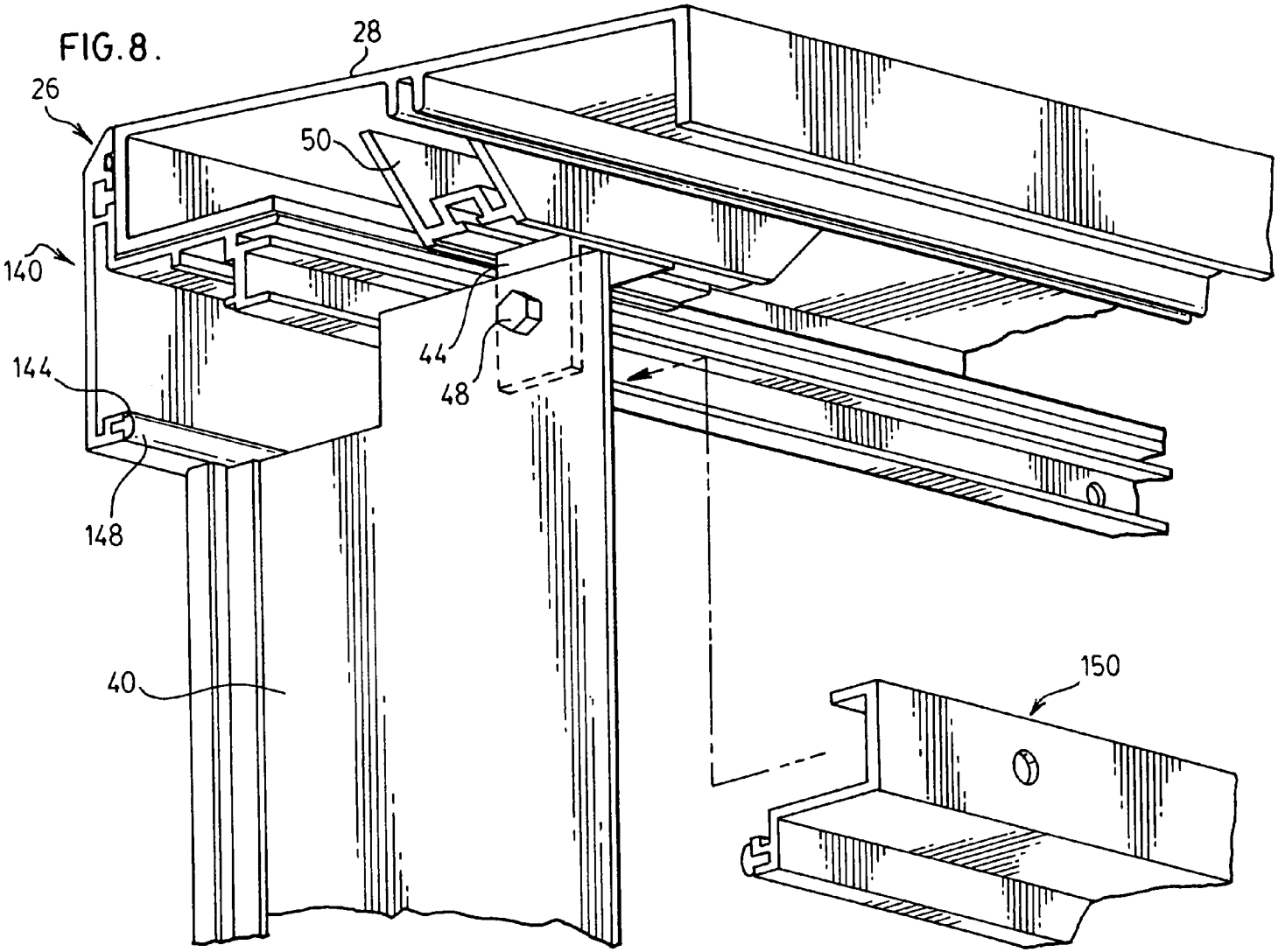
FIG. 8 is a detail, partially expanded, of the attachment of a vertical support member to an upper frame member in a sign according to the present invention.
Figure 9:
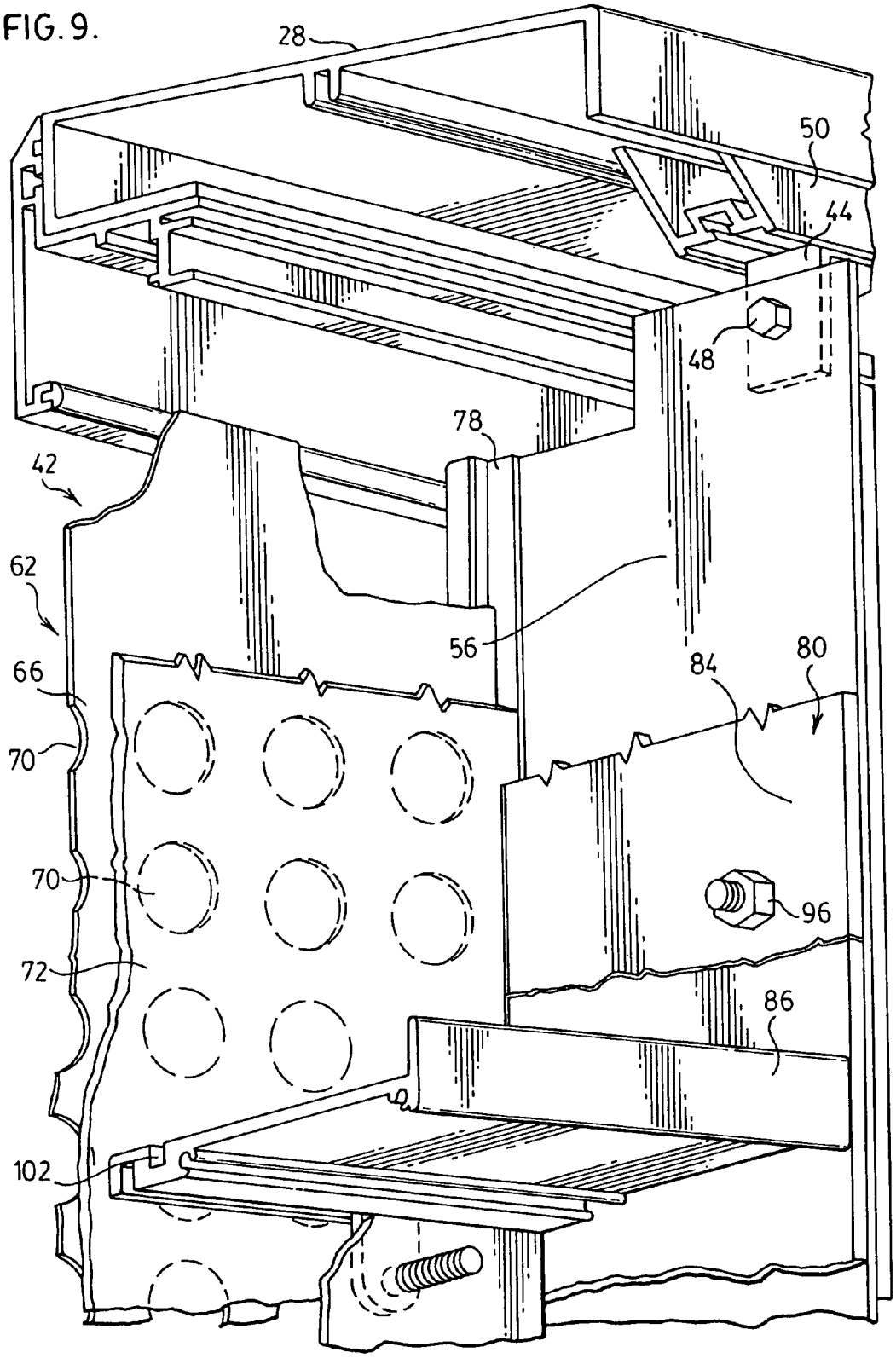
FIG. 9 is a cut-away view of a detail of the attachment of a vertical support member to an upper frame member and of the attachment of a ladder assembly to a vertical frame member in a sign according to the present invention.

As advantageously shown in FIGS. 4, 8 and 9, each vertical support means 40 is attached to upper and lower frame members 28 and 30 via upper and lower L-brackets 44 and 46. L-brackets 44 and 46 are attached to vertical support member 40 by bolts 48. L-brackets 44 and 46 are in turn bolted into slotted tracks 50 affixed to the upper and lower frame members 28 and 30. Bolts 52 secure the L-brackets 44 and 46 to the slotted tracks 50. Loosening bolts 52 allows the horizontal positioning of vertical support member 40 to be adjusted somewhat, if necessary. Once accurately located, bolts 52 may be secured to hold a vertical support member 40 in its desired position.

It will be noted that, in the illustrated embodiment shown in FIG. 4, upper and lower frame members 28 and 30 define profiles which preferably angle the front surface of front panel assembly 12 slightly downwardly, so that the sign 10 will have better visibility to passing motorists.

Figure 5:
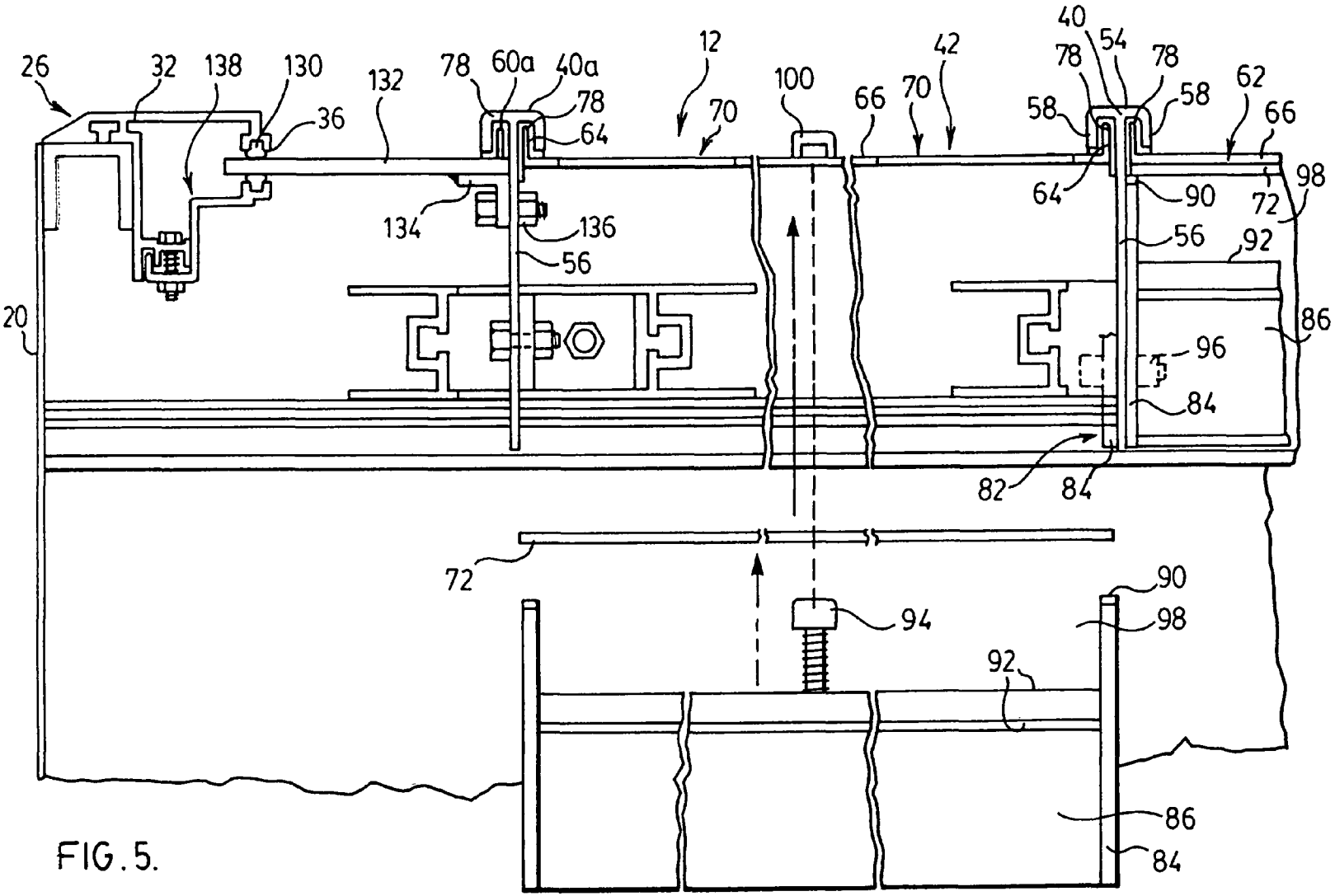
FIG. 5 is a horizontal cross-section, partially expanded, of the left side of the front panel assembly of a sign according to the present invention.
Figure 6:
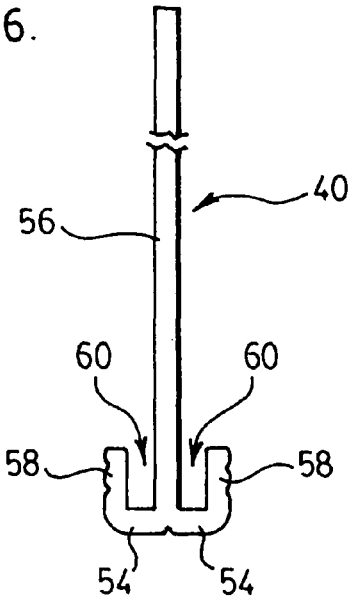
FIG. 6 is a horizontal cross-section of a vertical support member used in a sign according to the present invention.

At best shown in FIGS. 5 and 6, each vertical support member 40 defines a generally T-shaped cross-section with left and right arm structures 54 and a rearwardly extending stem 56. In the preferred embodiment as illustrated, arm structures 54 have rearwardly extending arm flanges 58 whereby to define a securement slot 60 between each arm flange 58 and the rearwardly extending stem 56.

A panel web assembly 62 extends across each rectangular opening 42 and is supported by arm structures 54 on neighboring vertical support members 40. In the illustrated embodiment, a panel web assembly 62 is supported by the flanges 58 on neighboring vertical support members 40.

Preferably, the panel web assemblies 62 define frontwardly extending side flanges 64, which are fitted into securement slots 60 on neighboring vertical support members 40. Side flanges 64 provide a more secure engagement of the panel web assemblies 62 to the vertical support members 40 as well as added structural stiffness to the panel web assemblies 62 and the front panel assembly 12 as a whole.

Figure 10:
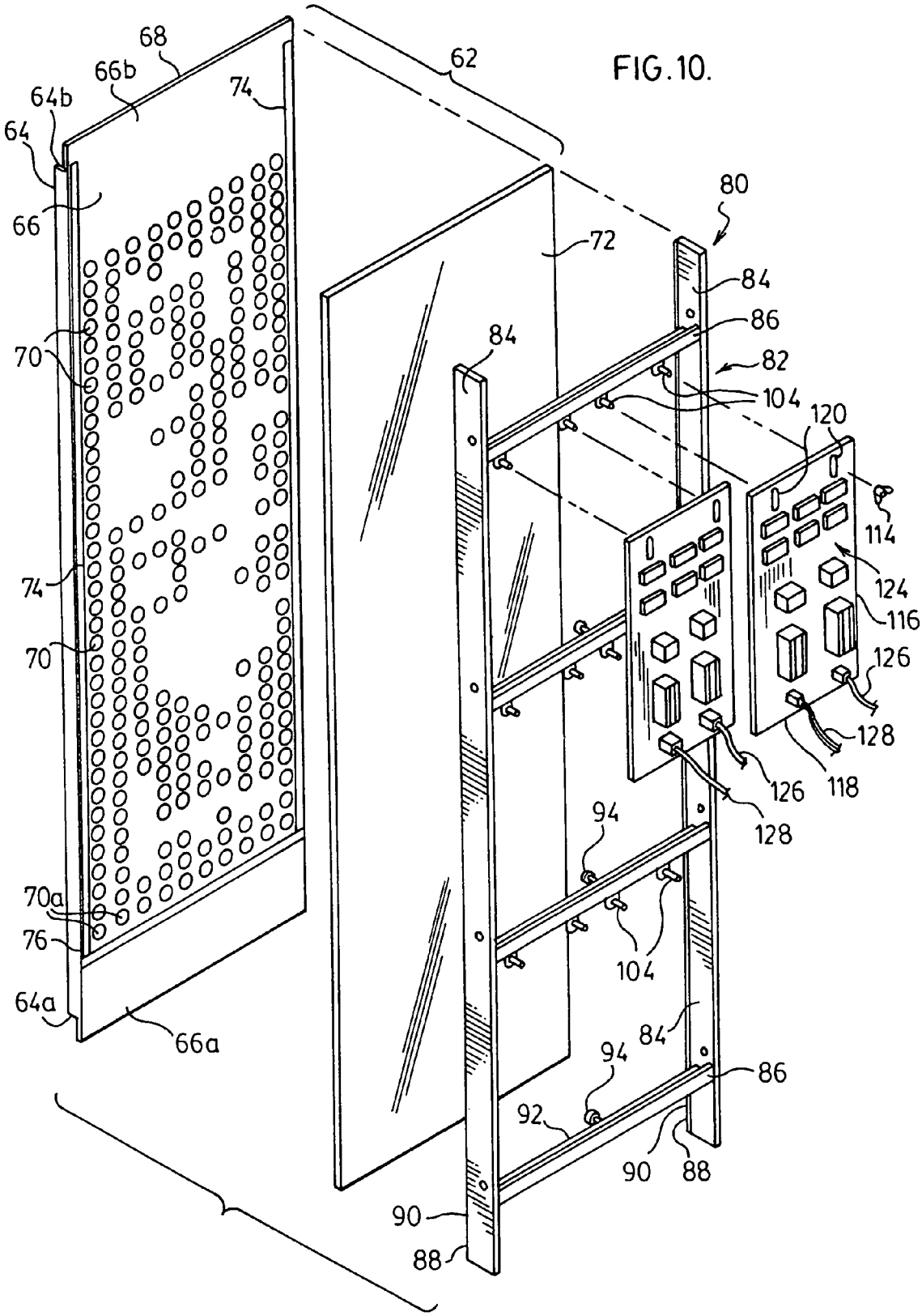
FIG. 10 is an expanded perspective view of a panel web assembly and a ladder assembly with attached sign modules in a sign according to the present invention.

As shown in FIG. 10, preferably flanges 64 do not extend the entire length of a panel web assembly 62. Instead, they stop a short (say about one or two inches) but pre-determined distance from the top and bottom of panel web assembly 62, thereby defining a flange bottom 64*a* and a flange top 64*b*, as well as a lower panel extension 66*a* and an upper panel extension 66*b*.

Figure 13:
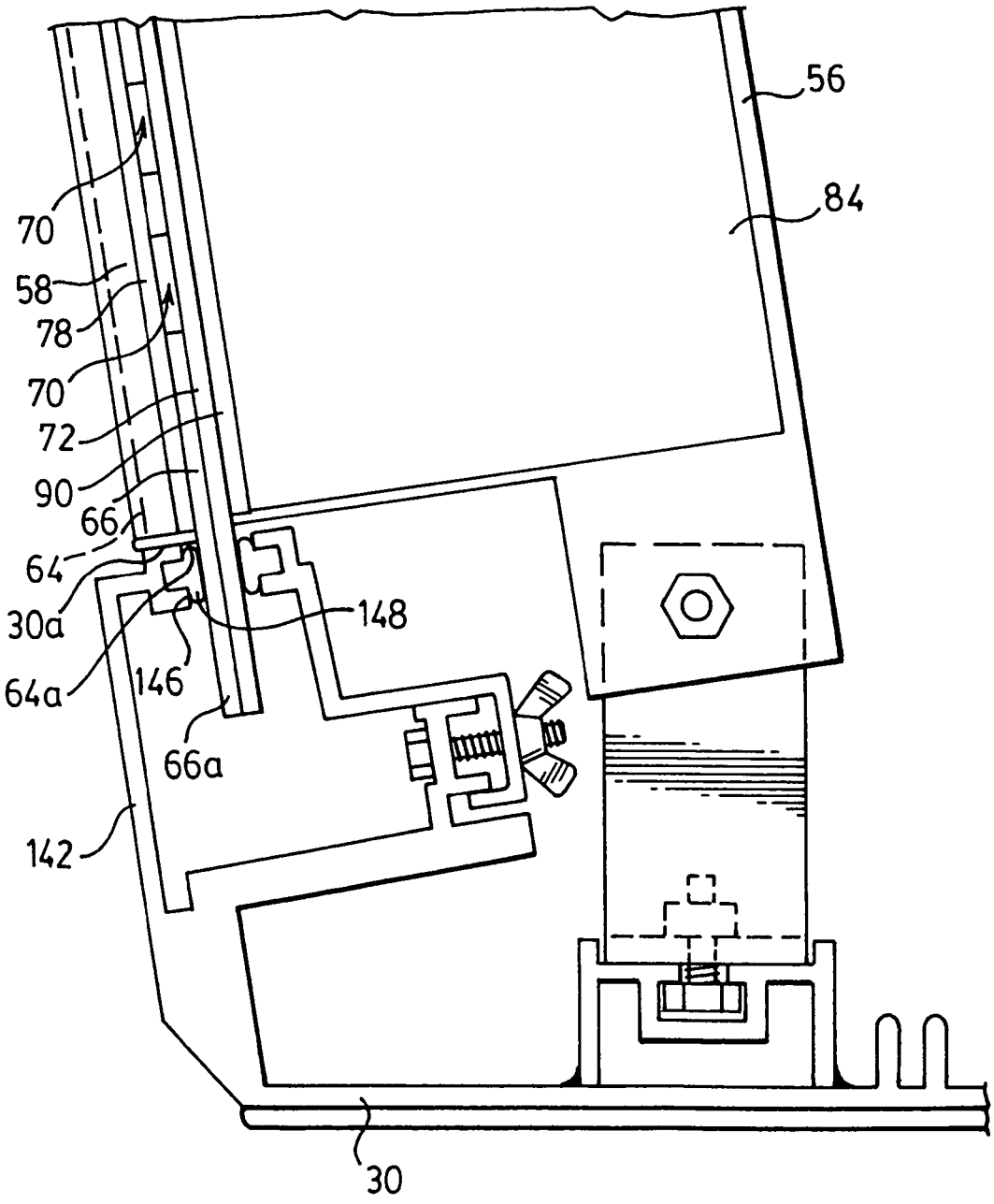

During construction of the front panel assembly 12, flanges 64 are, as described above, inserted into securement slots 60. Panel web assembly 62 is then lowered until flange bottom 64*a* is resting on a panel support surface portion 30*a* of lower frame member 30 (as shown in FIG. 13). In this manner, flanges 64 serve to support panel web assembly 62 during the remainder of the construction process and also provide vertical registration of the panel web assembly 62 with the frame structure 26. In addition, during maintenance operations, the panel web assembly 62 may be removed and replaced with vertical registration intact by using the flange bottom 64*a* and panel support surface portion 30*a* as locating surfaces.

As well shown in FIGS. 9 and 10, each panel web assembly 62 comprises a flanged aperture mask panel 66 and a window panel 72. Aperture mask panel 66 has a front surface 68 which preferably has a dark, non-reflective finish. Aperture mask panel 66 defines an array of regularly spaced mask openings 70 behind which changeable sign pixels, such as LED elements, are located (as described below). Typically, aperture mask openings 70 are circular, about 2 inches in diameter and are spaced about ¾ inches apart in a regular rectangular array. As is known in the art, providing a dark, non-reflective surface 68 will increase the contrast and visibility of the pixels exposed through the mask openings 70 and thus improve the contrast and visibility of the message displayed by the sign structure 10. Preferably, aperture mask panel 66 is made out of aluminum with a black painted front surface 68.

Figure 7:
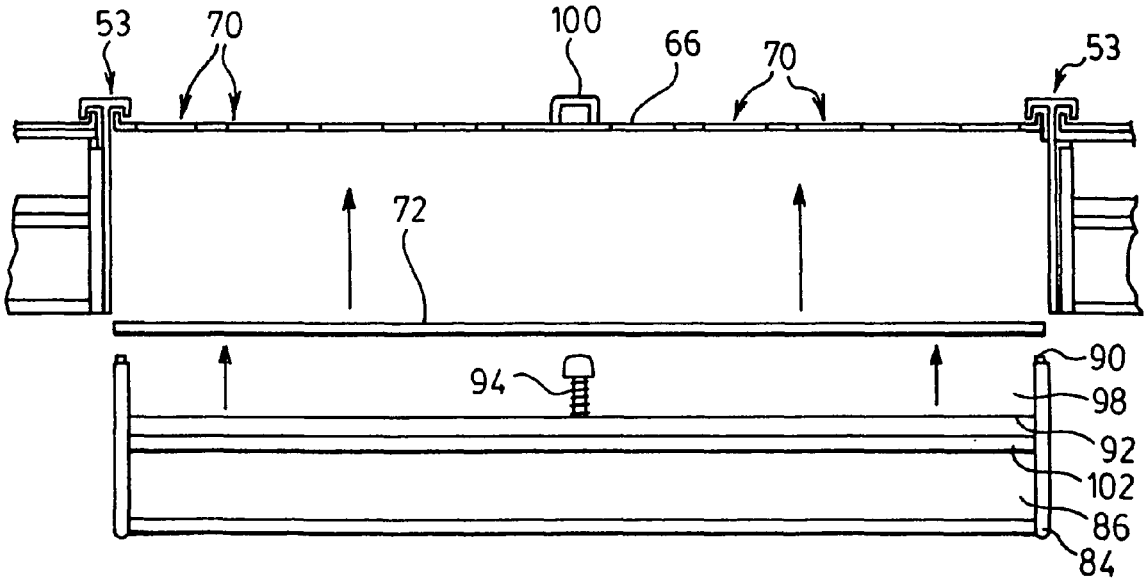
FIG. 7 is a horizontal cross-section, partially expanded, of a central portion of the front panel assembly of a sign according to the present invention.

For esthetic as well as for structural stiffening purposes, an optional panel mullion 100 may be attached, for example by screws (not shown), to the front surface of aperture mask panel 66 extending vertically down the middle of panel 66 (see FIGS. 1, 5 and 7). The outer profile of mullion 100 matches the outer profile of vertical support members 40, so as to achieve a uniformity of appearance. For example as shown in FIG. 1, every second vertical element is a vertical support member 40 with mullions 100 in between.

Behind aperture mask panel 66 is window panel 72. The purpose of window panel 72 is to prevent water, dust, salt spray, insects and other potentially damaging external environmental material from entering the sign through the mask openings 70, thus protecting the sign interior 22 and the sign components therein (as described below). Window panel 72 is made of any robust, light-transmitting (preferably transparent) material. Preferably, the material will not suffer from significant degradation under ultraviolet exposure. Commonly, clear polycarbonate, for example as sold under the trademark LEXAN, has been found to be a good choice.

Aperture mask panel 66 and window panel 72 are disengagingly tacked together during assembly by side gasket strips 74 made from double-sided tape of a resilient material (see FIG. 10). In addition, a bottom gasket strip 76 made from the same double-sided tape is also applied immediately beneath the lowest row of mask openings 70*a*. In addition to holding the mask panel 66 and window panel 72 together during assembly, the side and bottom gasket strips 74 and 76 assist in preventing or reducing rainwater from entering the interior of the sign structure 12. Of particular benefit, bottom strip 76 will assist in redirecting any water that may enter any of the mask openings and flow downward between panels 66 and 72 back out to the sign's exterior through the lower-most mask openings 70*a*. During maintenance, as described below, if necessary, the tacked connection provided by the use of double-sided tape may be disengaged to allow on-site separation of the aperture mask panel 66 and window panel 72 for servicing or replacement of either or both panels. After servicing is complete, a tacked connection between such panels 66 and 72 may be re-established by either re-using the same double-sided tape already in place or by applying new double-sided tape where needed.

Preferably, a sealing gasket 78 of resilient material is located between panel web assembly 62 and the arm structure 54 (see FIGS. 4 and 5). In the illustrated embodiment, the gasket 78 fits within and lines securement slot 60 and extends over the end of flanges 58.

As shown in FIGS. 5, 9 and 10, located rearwardly of panel web assembly 62 is web assembly support structure 80. In the illustrated embodiment, web assembly support structure 80 comprises a ladder assembly 82 having left and right rails 84 and rungs 86 attached thereto. Rails 84 define forward edges 88. Forward edges 88 may optionally have a pad or gasket 90 extending along the length of rails 84. Rungs 86 are of a width to ensure that ladder assembly 82 fits closely between stems 56 of neighboring vertical support members 40. In this manner, horizontal registration of ladder assembly 82 with frame structure 26 and panel web assembly 62 supported thereby is achieved.

Rungs 86 have a forward edge 92 which is spaced rearwardly from the rail forward edges 88. One or more optional padded rung abutments 94 may be attached to the forward edge 92 of one or more rungs 86, whereby to present an abutment surface at about the same position as forward edges 88. When wind or other forces push against the sign structure 10 or its panel web assemblies 62, the use of such rung abutments 94 (particularly if a ladder assembly 82 is relatively wide) may provide additional support for the central portions of the panel web assemblies 62.

A ladder assembly 82 is in contact with, and in fact is pressed against, the rear surface of a panel web assembly 62, pushing the panel web assembly 62 forward and holding it in place against arm structures 54. More specifically, in the illustrated embodiment, ladder assembly 82 pushes the panel side flanges 64 into securement slots 60 and the front surface 68 of aperture mask panel 66 against flanges 58 via sealing gasket 78. Once pressed into place, ladder assembly 82 is removably attached to the rearwardly extending stem 56 of neighboring vertical support members 40.

As shown in FIGS. 4 and 5, the recessed position of forward edge 92 of rungs 86 defines a gap 98 between rungs 86 and the rear surface of panel web assembly 62.

Figure 12:
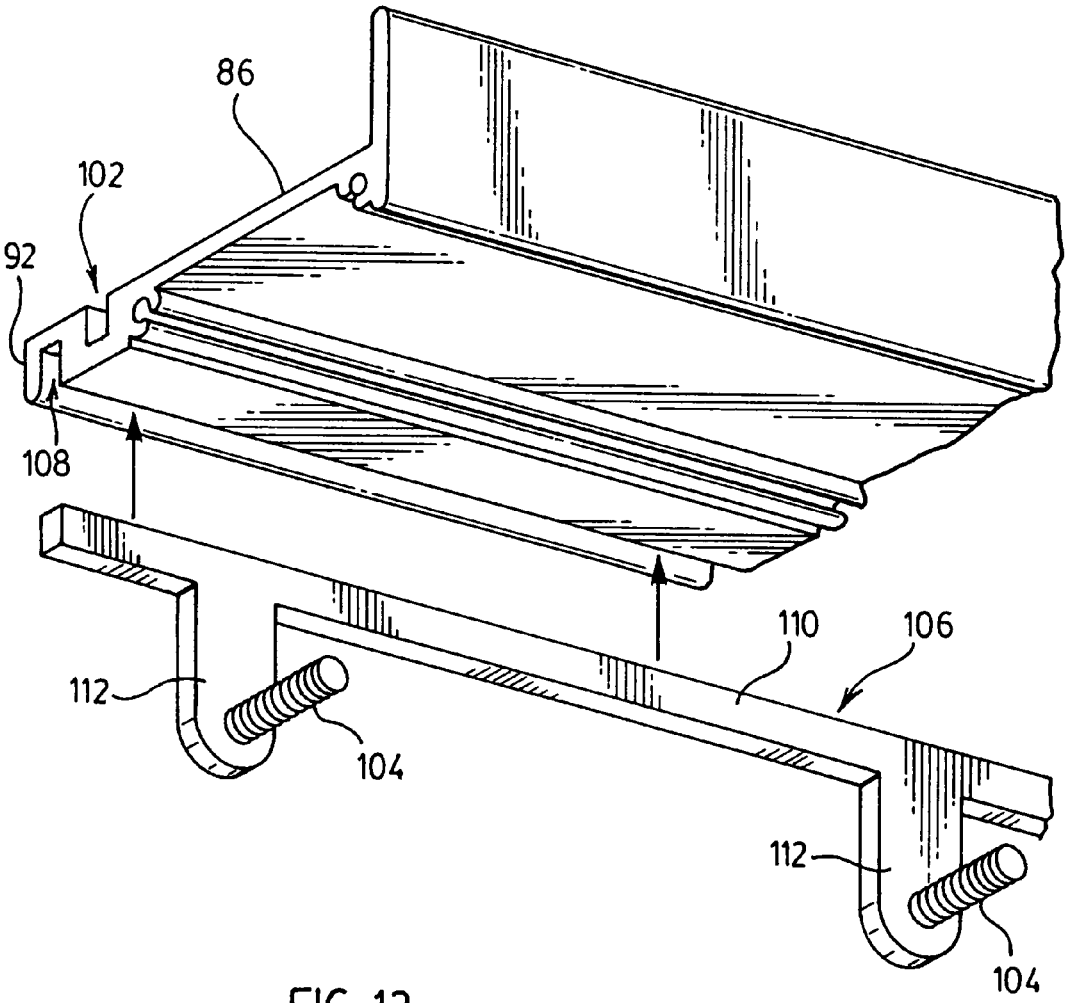
FIG. 12 is an expanded perspective view of a ladder rung and locating pin structure of a ladder assembly in a sign according to the present invention; and, FIG. 13 is a vertical cross-section of a detail of the bottom edge of a front panel assembly of an alternate embodiment of a sign according to the present invention.

Rungs 86 may be attached to rails 84 by any suitable means. Rungs 86 define a registration slot 102. In addition, locating pins 104 are mounted to the underside of rungs 86, except the lowermost thereof. Locating pins 104 may be mounted to rungs 86 by any suitable means. In the illustrated embodiment, a locating pin assembly 106 is press-fitted into a locating pin assembly slot 108 on the bottom of rungs 86 (see FIG. 12). The locating pin assembly 106 consists of a locating pin base 110 extending from one side of rung 86 to the other. Locating pin base 110 defines locating pin tongues along the length thereof. The locating pins 104 are mounted to tongues 112. The edges of locating pin assembly 106 are aligned with the edges of a rung 86, thus providing horizontal location of the locating pins themselves relative to the rails 84. In the illustrated embodiment, the locating pins 104 are threaded whereby to accept a butterfly nut 114.

At least one changeable message electronic sign module 116 is removably attached to, and in registered relationship to, ladder assembly 82. In a typical sign, numerous sign modules 116 will be used. For example, in a large sign of the size previously mentioned, anywhere from 30 to 90 sign modules 116 may be used. In the illustrated embodiment, up to 6 sign modules 116 may be attached to a single ladder assembly 82.

Figure 11:
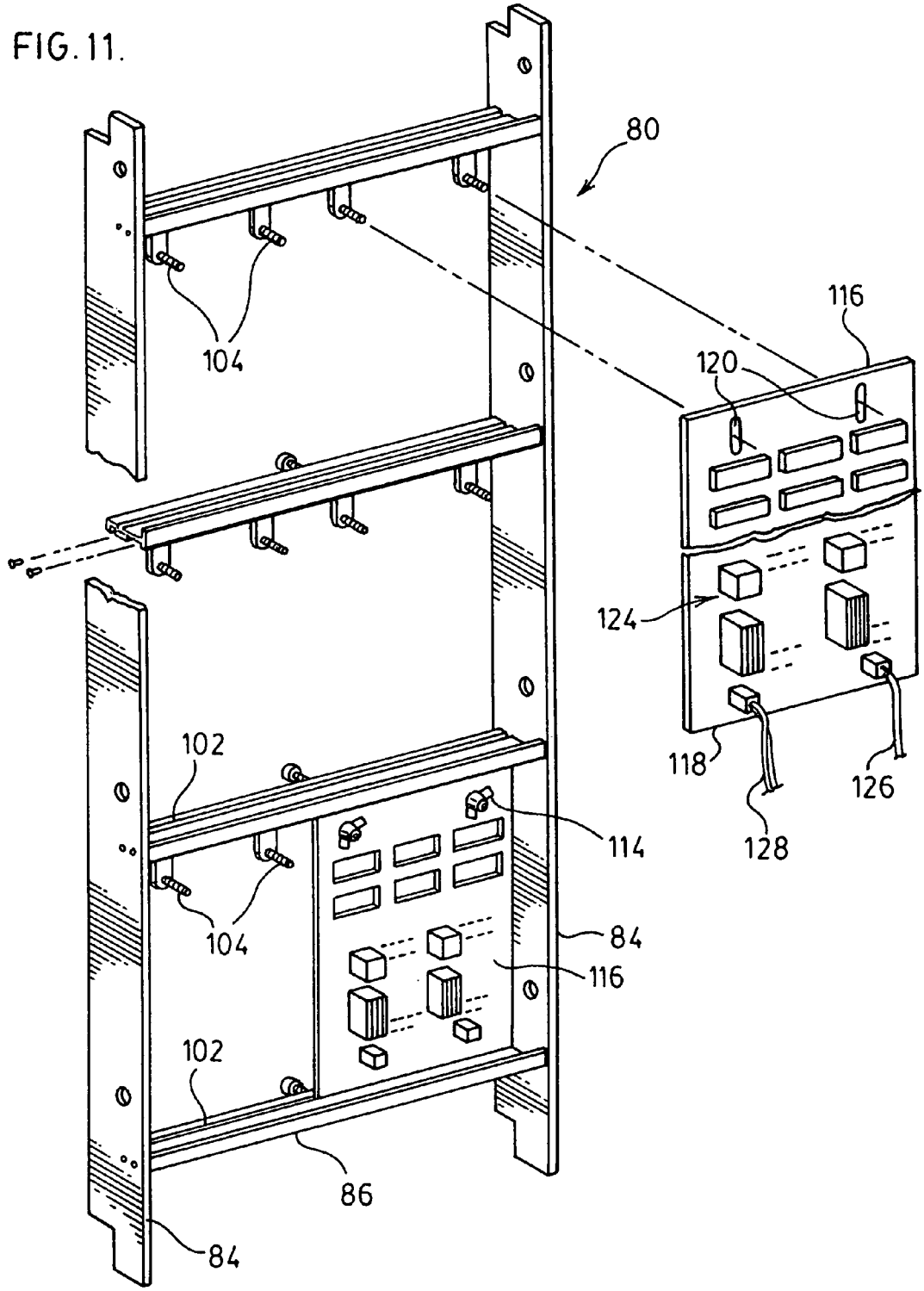
FIG. 11 is a perspective view, partially cut-away and partially expanded, of a ladder assembly with attached sign modules in a sign according to the present invention.

As shown in FIGS. 10 and 11, sign modules 116 are essentially circuit boards comprising an array of sign display pixels 122 on the front (see FIG. 4) and electronic control circuitry 124 on the back. The array of sign display pixels 122 on the front of the module 116 will match a portion of the array of openings 70 in aperture mask 66 whereby, when properly registered, each display pixel 122 will be visible through an opening 70. As is well known in the art, electrical power to each sign module 116 is provided by a power cable 126 and data from a remote sign controller or computer (not shown) is delivered via a data cable 128. The sign pixels 122 will turn ON or OFF in accordance with data supplied by the remote sign controller or computer (not shown). Preferably, the sign pixels 122 are conventional clusters of light emitting diodes (LEDs), such as are well known in the art. Such LED pixels provide a very bright light which, particularly when surrounded by the aperture mask 66, is readily visible to passing motorists.

Sign module 116 defines vertically oriented upper mounting slots 120 through which locating pins 104 may snugly pass. In mounting a sign module 116 to ladder assembly 82, module 116 is placed so that pins 104 pass through slots 120. Module 116 is then lowered until its lower edge 118 is resting in registration slot 102. Vertical registration of module 116 to ladder assembly 82 is achieved in this manner. Horizontal registration is achieved by the fit of pins 104 in slots 120. Butterfly nuts 114 are tightened to hold the module 116 in place on ladder assembly 82.

As noted above, once pressed into place against a web panel assembly 62, ladder assembly 82 is removably attached to the rearwardly extending stem 56 of neighboring vertical support members 40. In the illustrated embodiment, the removable attachment is achieved by bolts 96. During assembly of the front panel assembly 12, adjacent ladder assemblies 82 on opposite sides of the stem 56 of a vertical support member 40 are pressed into place, held in place by suitable clamps and suitable holes drilled through rail 84 of one ladder assembly 82, stem 56 and rail 84 of the neighboring ladder assembly 82. In a typical sign of the size mentioned above, 3 or 4 bolts 96 will be sufficient per rail to secure ladder assemblies 82 into place whereby to sealingly press panel web assembly 62 into place against the arm structures 54 of vertical support members 40. Preferably, as best shown in FIGS. 5, 9 and 11, bolts 96 will be located rearward of the rearward side of sign modules 116 where they can be accessed from the interior 22 of the sign structure 10 without having to remove any sign modules 116.

In constructing a sign structure 10, it is important to ensure that the sign pixels 122 are in registered relationship to the openings 70 in aperture mask 66. As described above, (1) the sign pixels 122 of module 116 are registered horizontally and vertically to the ladder assembly 82; (2) aperture mask 66 is registered vertically to the frame 26 of the sign structure 10 via the contact between flange bottom 64*a* and panel support surface portion 30*a*; and (3) ladder assembly 82 is registered horizontally to the frame 26 of the sign structure 10 via the snug fit of the ladder assembly 82 between the stems 56 of neighboring vertical support members 40. All that remains is to achieve registration vertically between the ladder assembly 82 and the frame 26 or, more specifically, openings 70 of aperture mask 66 located relative thereto. Such registration is achieved in the following manner.

During the process of installing each ladder assembly 82 against panel web assembly 62, at least one sign module 116 is attached in the manner described above to the ladder assembly 82 being installed. Ladder assembly 82 is moved into place against the rear surface of panel web assembly 62. The position of ladder assembly 82 is then vertically adjusted so that sign module 116 is externally confirmed as being in registered relationship to the aperture mask openings 70 before being clamped or otherwise secured into place for the bolt-attaching operation described above. For example, as shown in FIG. 4, the center of an LED pixel 122 is aligned with the center of a corresponding mask opening 70 along the line 200. Once initially attached in this manner, registration during subsequent removal and re-attachment will be reacquired by re-using the same bolts 96 and bolt holes. With this manner of mounting, in a completed sign structure 10, sign modules 116 and/or ladder assemblies 82 may be readily removed, for example for servicing of sign components, and replaced in registered relationship to the ladder assembly 82 and/or mask openings 70.

In the illustrated embodiment, the ladder assemblies 82 have two sign modules 116 attached to each rung 86. In other embodiments, for example depending on the overall length of sign structure 10, at least one ladder assembly 82 may be required to carry a different number of sign modules 116 per rung 86. For example, in a case where only one sign module 116 per rung 86 is required, such ladder assembly 82 need only be of a width to carry the one module 116 per rung 86. The sizing of the corresponding panel web assembly 62 and the spacing of the corresponding vertical support members 40 are adjusted accordingly. Despite the inclusion of an odd-sized panel web assembly 62, if mullions 100 are used, the overall external appearance of the sign structure 10 remains uniform and pleasing to the eye.

Referring now to FIG. 5, the construction of the left hand side of the front panel assembly 12 is shown. The construction (not shown) of the right hand side of the front panel assembly 12 is substantially the same. The left-most vertical support member 40*a* is the same as other vertical support members 40 used in the front panel assembly 12. As previously described, the left side frame member 32 defines a left side panel support surface 36. Preferably, a gasket 130 is attached thereto. A closing panel 132 is sealingly engaged against gasket 130 supported by left side panel support surface 36. Closing panel 132 may be any suitable material but preferably for esthetic purposes the front surface thereof will match the appearance of aperture mask panel 66. Closing panel 132 is unlikely in the conventional case to have any sign modules 116 behind it and, accordingly, in the normal case panel 132 does not have any openings in it corresponding to openings 70 in aperture mask panel 66. At its left side, closing panel 132 is removably held in sealing engagement against gasket 130 by a side clamping arrangement 138 attached to the left side frame member 32. At the right side of closing panel 132, L-brackets 134 are attached to closing panel 132. Panel 132 is sealingly engaged against gasket 78 and removably attached to stem 56 by bolts 136 engaging the L-brackets 134; panel 132 may optionally have a right-side flange (not shown) to be inserted into securement slot 60*a*.

To assist in keeping water, dust, insects and other potentially damaging environmental material out of sign structure 10, each panel web assembly 62 is also preferably sealingly clamped into place at its top and bottom. Referring to FIG. 4, upper panel support member 140 is attached to, or is an integral part of, upper frame member 28. Similarly, lower panel support member 142 is attached to, or is an integral part of, lower frame member 30 (in the detail of FIG. 13, lower panel support member 142 is shown as an integral part of lower frame member 30). Upper and lower panel support members 140 and 142 define upper and lower panel support surfaces 144 and 146, respectively. As previously described, lower frame member 30 defines a panel support surface portion 30*a*, which in fact as shown is part of the lower panel support member 142. Preferably, a sealing gasket 148 is attached to each of the upper and lower panel support surfaces 144 and 146. An upper clamping arrangement 150 is attached to upper panel support member 140 or upper frame member 28 and sealingly engages the upper portion 66*b* of panel web assembly 62 against sealing gasket 148 supported by upper panel support surface 144. Similarly, a lower clamping arrangement 152 is attached to lower panel support member 142 or lower frame member 30 and sealingly engages the lower portion 66*a* of panel web assembly 62 against sealing gasket 148 supported by lower panel support surface 146.

If, despite the presence of the various seals and gaskets described, some water does enter the sign structure 10, suitable drain holes 154 are provided in the bottom of the lower frame member 30 and bottom panel 18.

Referring again to FIG. 4, it will be seen that, in the assembled front panel assembly 12, gaps 98 extend generally between neighboring vertical support members 40 and from the bottom to the top of the vertical support members 40. As ladder assembly 82 is open at both top and bottom, air may circulate from the interior 22 of sign 10 through gap 98 back into interior 22. Such air circulation is desirable so as to cool LED pixels 122 and also to reduce condensation on surfaces that might interfere with the visibility of sign modules. To assist such air circulation, a plenum structure 156 is provided to close off the top of each ladder assembly 82. More specifically, the plenum structure 156 is attached to the upper frame member 28 and extends down to an uppermost rung 86 of ladder assembly 82. It is not necessary to close off the entire rearward section of the ladder assembly 82 because the sign modules 116 themselves substantially close off and separate gap 98 from interior 22. The plenum structure 156 defines an opening 158 into which a ventilation fan 160 is mounted.

In operation, if it is desired to change an aperture mask panel 66 or a window panel 72 (for example, if they have been vandalized or otherwise damaged or are in need of servicing), a service person may enter the sign structure 10 via access door 24. The specific panel web assembly 62 to be serviced is identified by the service person from inside the sign. Power and data cables 126 and 128 of the appropriate sign modules 116 may be unplugged or otherwise detached. At the preference of the service person, the sign modules 116 may, if desired, be removed by undoing the butterfly nuts and removing the panels from registration slots 102. Next, the ladder assembly 82 (either empty or with one or more sign modules 116 still attached, as the service person may choose) is removed from its attachment to stem 56 by removing bolts 96. Upper and lower clamping arrangements 150 and 152 are released or removed. At this point, the service person may remove either the window panel 72 only or, only if need be, the entire panel web assembly 62, including both window panel 72 and aperture mask panel 66 from their supported position against the arm structures 54 of neighboring vertical support members 40. To separate the window panel 72 from the aperture mask panel 66, the service person disengages the tacked connection between them by pulling them apart to release the adhesion provided by double-sided tape strips 74 and 76. The components may then be serviced and/or replaced and then re-installed. If necessary, the service person will ensure that a tacked connection is established between the window panel 72 and the aperture mask panel 66 by either re-using the existing double-sided tape strips 74 and 76 if still viable or applying fresh double-sided tape strips 74 and 76. The replacement panel web assembly 62 may then be placed at its supported position against the arm structures 54 of neighboring vertical support members 40 and vertically supported and registered by the bottoms 64*a* of flanges 64 resting on panel support surface portion 30*a*. The replacement panel web assembly 62 is clamped at the top 66*a* and bottom 66*b* by upper and lower clamping arrangements 150 and 152. Ladder assembly 82 is then replaced, pressed against the replacement web assembly 62 and bolts 96 re-secured. Any removed sign modules 116 are then reattached by inserting them first onto locating pin structures 104 and then down into registration slots 102 and then securing them with butterfly nut 114. Cables 126 and 128 are re-attached.

Similarly, if it is desired to change a closing panel 132 (again, for example, if vandalized or otherwise damaged), the service person may do so by removing bolts 136 and releasing or removing side clamping arrangement 138 and upper and lower clamping arrangements 150 and 152. Closing panel 132 may then be removed from its supported position against the arm structures 54 of vertical support members 40*a* and side panel support surface 36 or 38, as the case may be, for service or replacement. The serviced or replacement panel 132 is then placed at its supported position against the arm structures 54 of vertical support members 40*a* and side panel support surface 36 or 38, as the case may be. The replacement panel 132 is clamped at the top and bottom by upper and lower clamping arrangements 150 and 152 and at the side by side clamping arrangement 138. Closing panel 132 is then pressed against the arm structure 54 of vertical support member 40*a* and bolts 136 re-secured.

Although various preferred embodiments of the present invention have been described herein in detail, it would be appreciated by those skilled in the art that variations may be made thereto The embodiments of the invention in which an exclusive property or privilege is claimed are defined as follows:

1. A changeable message sign structure comprising:

a hollow enclosure having a front panel assembly and rear, top, bottom and left and right end panels defining a sign interior;

wherein the front panel assembly comprises:

frame having upper, lower and left and right side frame members, at least two vertical support members attached to the upper and lower frame members, each said vertical support member defining a generally T-shaped cross-section with a rearwardly extending stem and left and right arms, each with arm flanges extending rearwardly to define securement slots between the arm flanges and the stem, at least one panel web assembly having frontwardly extending side flanges engaged within a securement slot of each of two neighbouring vertical support members, a web assembly support structure pressed against said at least one panel web assembly and removably attached to the rearwardly extending stems of said two neighbouring vertical support members, and, at least one changeable message electronic sign module attached to the web assembly support structure, wherein the upper and lower frame members define support surfaces and said at least one panel web assembly is supported thereagainst, and, further comprising seals between said at least one panel web assembly and said arms and support surfaces.

2. A changeable message sign structure comprising:

a hollow enclosure having a front panel assembly and rear, top, bottom and left and right end panels defining a sign interior;

wherein the front panel assembly comprises:

a frame having upper, lower and left and right side frame members, at least two vertical support members attached to the upper and lower frame members, each said vertical support member defining a generally T-shaped cross-section with a rearwardly extending stem and left and right arms, each with arm flanges extending rearwardly to define securement slots between the arm flanges and the stem, at least one panel web assembly having frontwardly extending side flanges engaged within a securement slot of each of two neighbouring vertical support members, a web assembly support structure pressed against said at least one panel web assembly and removably attached to the rearwardly extending stems of said two neighbouring vertical support members, and, at least one changeable message electronic sign module attached to the web assembly support structure, wherein a sealing gasket is located in each said securement slot and across a rearward end of the arm flange, and, wherein at least one panel web assembly is an apertured panel assembly comprising an aperture mask panel, defining multiple mask apertures, and a transparent window panel rearward thereof and wherein the side flanges are defined by the aperture mask panel.

3. A changeable message sign structure as claimed in claim 2 wherein said web assembly support structure with said at least one electronic sign module attached thereto is attached to said rearwardly extending stems whereby said at least one electronic sign module is in registered relationship to apertures in the aperture mask panel.

4. A changeable message sign structure as claimed in claim 3 wherein said at least one electronic sign module is removably attached to the web assembly support structure in registered relationship thereto.

5. A changeable message sign structure as claimed in claim 4 wherein a web assembly support structure comprises a ladder assembly having left- and right-hand rails defining rail forward edges pressed against a rear surface of the apertured panel assembly and rungs defining a rung forward edge spaced rearwardly from the rail forward edges and the at least one electronic sign module is attached rearwardly of said rail forward edges to define a gap between a front surface of said module and the rear surface of the apertured panel assembly.

6. A changeable message sign structure as claimed in claim 5 wherein the electronic sign modules have multiple LED pixels mounted to a circuit board for controlling the operation thereof.

7. A changeable message sign structure as claimed in claim 6 wherein the gap in front of a lowermost electronic sign module bottom of a ladder assembly is open to the sign interior and further comprising a fan arrangement mounted above the ladder assembly to draw air through said gap.

8. A method of removing and re-installing a panel web assembly in a changeable message sign structure comprising:

a hollow enclosure having a front panel assembly and rear, top, bottom and left and right end panels defining a sign interior, one of said panels having an access door for entry into the sign interior, and in which the front panel assembly has:

a frame having upper, lower and left and right side frame members, at least two vertical support members attached to the upper and lower frame members, each said vertical support member defining a generally T-shaped cross-section with a rearwardly extending stem and left and right arms, each with arm flanges extending rearwardly to define securement slots between the arm flanges and the stem, at least one panel web assembly having frontwardly extending side flanges engaged within a securement slot of each of two neighbouring vertical support members, a web assembly support structure pressed against said at least one panel web assembly and removably attached to the rearwardly extending stems of said two neighbouring vertical support members, and at least one changeable message electronic sign module attached to the web assembly support structure, the method comprising the steps of:

from interior of a sign structure detaching the removably attached web assembly support structure from the rearwardly extending stems of two neighbouring vertical support members;

removing an exposed panel web assembly from its position against said arms;

positioning a panel web assembly against said arms;

pressing the web assembly structure against the positioned panel web assembly and removably attaching same to the rearwardly extending stems;

wherein said at least one electronic sign module is removably attached to the web assembly support structure in registered relationship thereto and the method comprises an additional first step of removing said at least one electronic sign module from the web assembly support structure and an additional last step of removably re-attaching said at least one electronic sign module to the web assembly support structure in registered relationship thereto; and, wherein said panel web assembly is comprised of a generally planar aperture mask panel, defining multiple mask apertures, and a generally planar transparent window panel disengagingly secured to the aperture mask panel by a tacked connection and wherein the method further comprises, after the step of removing the exposed panel web assembly, the additional steps of:

disengaging the tacked connection between the removed aperture mask panel and window panel, replacing one of the removed aperture mask panel or the window panel, establishing a tacked connection between a replacement aperture mask panel or window panel, as the case may be, and the other of the removed aperture mask panel or window panel, as the case may be, to fabricate a replacement panel web assembly.

9. A method as claimed in claim 8 wherein said tacked connection is established by double-sided tape between the aperture mask panel and the window panel.

* * * * *